US005661972A

United States Patent [19]

Katoh et al.

[11] Patent Number: 5,661,972

[45] Date of Patent: Sep. 2, 1997

[54] AIR-FUEL RATIO CONTROL SYSTEM FOR INTERNAL COMBUSTION ENGINES

[75] Inventors: Akira Katoh; Hiroshi Kitagawa; Jun Takahashi, all of Wako, Japan

[73] Assignee: Honda Giken Kogyo Kabushiki Kaisha, Tokyo, Japan

[21] Appl. No.: 426,615

[22] Filed: Apr. 21, 1995

[30] Foreign Application Priority Data

May 9, 1994 [JP] Japan ..... 6-119516

[51] Int. Cl.[6] ..... F01N 3/28

[52] U.S. Cl. ..... 60/276; 60/285

[58] Field of Search ..... 60/276, 285

[56] References Cited

U.S. PATENT DOCUMENTS 5,357,754 10/1994 Ogawa ..... 60/285

FOREIGN PATENT DOCUMENTS 61-237858 10/1986 Japan .

63-97848 4/1988 Japan .

63-205441 8/1988 Japan .

*Primary Examiner*—Douglas Hart

*Attorney, Agent, or Firm*—Nikaido Marmelstein Murray & Oram LLP

[57] ABSTRACT

An air-fuel ratio control system for an internal combustion engine having a catalytic converter arranged in the exhaust system, has an upstream oxygen sensor and a downstream oxygen sensor arranged in the exhaust system at locations upstream and downstream of the catalytic converter, respectively. An ECU determines a feedback control constant, based on an output from the downstream oxygen sensor, and determines an air-fuel ratio control amount, based on the determined feedback control constant and an output from the upstream oxygen sensor. The ECU carries out feedback-control of the air-fuel ratio of a mixture supplied to the engine by means of the determined air-fuel ratio control amount. The updating rate of the feedback control constant is set based on the temperature of the catalyst of the catalytic converter.

9 Claims, 13 Drawing Sheets

FUEL INJECTION VALVE
6
1
INTERNAL COMBUSTION ENGINE
2
CYL
11
NE
10
TW
9
TA
8
PBA
7
θ TH
4
3
13
CATALYTIC CONVERTER
14
TCAT
17
O2
15
O2
16
5a
5b
5c
5d
INPUT CIRCUIT
C P U
MEMORY MEANS
OUTPUT CIRCUIT
ECU
5
VH
32

KO2 CALCULATION
S1
TW>TWO2 ?
NO
YES
S2
FWOT=0 ?
NO
YES
S3
UPSTREAM O2 SENSOR IN ACTIVATED STATE ?
NO
YES
S4
NE>NHOP ?
YES
NO
S5
NE≦NLOP ?
YES
NO
S6
DURING F/C ?
YES
NO
S7
KLS=1.0 ?
NO
YES
S8
UPSTREAM O2 SENSOR F/B CONTROL
S9
KO2←1.0
S10
KO2←KREF
EXIT

SecO2F/B MAIN ROUTINE
SecO2F/B EXECUTION DETERMINATION
S501
SecO2F/B INHIBITED ?
S502
YES
NO
SecO2F/B TEMPORARILY STOPPED ?
S505
YES
NO
SecF/B MODE
S508
S503
S509
S506
SecOPEN MODE
PL/PR-CALCULATION PROCESSING
SecREF MODE
PL←PINI PR←PINI
PREF-CALCULATION PROCESSING
PL←PLREF PR←PRREF
S504
S510
S507
RETURN

TCAT ESTIMATION
S210
ENGINE BEING STARTED ?
YES
NO
S230
ΔTCAT>0 ?
NO
YES
S240
S250
RETRIEVE ToutSUM/α1 TABLE
RETRIEVE ToutSUM/α2 TABLE
RETRIEVE Kα
S255
TCATOBJ0 (RETRIEVE NE×PBA MAP)
S260
RETRIEVE KA/F
S265
S220
TCAT=TA
RETRIEVE V, TA/KTATCAT
S270
TCATOBJ= KTATCAT×KA/F×TCATOBJ0
S280
TCAT=α×TCAT(n−1) +(1−α)×TCATOBJ
S290
EXIT

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines for controlling the air-fuel ratio of a mixture supplied to the engine in response to outputs from oxygen sensors arranged in the exhaust system of the engine, respectively, upstream and downstream of a catalytic converter arranged in the exhaust system.

2. Prior Art

Conventionally, an air-fuel ratio control system is known, which includes oxygen sensors arranged in the exhaust system of an internal combustion engine, respectively, upstream and downstream of a catalytic converter (e.g. three-way catalyst) arranged in the exhaust system, and controls the air-fuel ratio of a mixture supplied to the engine in a feedback manner responsive to outputs from these oxygen sensors, so as to improve exhaust emission characteristics of the engine. According to this air-fuel ratio control system, an air-fuel ratio correction coefficient KO2 which has a value thereof determined by the output from the oxygen sensor upstream of the catalytic converter (hereinafter referred to as "the upstream oxygen sensor"), or a reference value for determining whether the air-fuel ratio is lean or rich, which is compared with the air-fuel ratio correction coefficient KO2 is changed by a feedback control constant based on the output from the oxygen sensor downstream of the catalytic converter (hereinafter referred to as "the downstream oxygen sensor"), to thereby compensate for deterioration of the upstream oxygen sensor, etc.

The above feedback control based on the output from the upstream oxygen sensor undergoes a problem that when the temperature of a catalyst of the catalytic converter (hereinafter simply referred as "the catalyst temperature") is low, the maximum oxygen storage capacity of the catalytic converter is low and unstable and accordingly the output from the downstream oxygen sensor is unstable, which can result in hunting of the value of the air-fuel ratio correction coefficient, etc. To solve this problem, it has been proposed to detect the temperature of the engine, the catalyst temperature or the like, and interrupt the feedback control based on the output from the downstream oxygen sensor when the detected temperature is lower than a predetermined value, e.g.. by Japanese Laid-Open Patent Publications Nos. 61-237858 and 63-97848).

Further, also when the catalytic converter is deteriorated, the oxygen storage capacity of the catalytic converter lowers. In view of this fact, it has also been proposed to interrupt the feedback control based on the output from the downstream oxygen sensor when the catalytic converter is deteriorated, e.g. by Japanese Laid-Open Publication No. 63-205441.

However, none of the above proposed methods make it possible to obtain results of the feedback control based on the output from the downstream oxygen sensor, i.e. effects such as prevention of degradation of exhaust emission characteristics of the engine ascribable to deterioration of the upstream oxygen sensor, etc., until after the catalytic converter has risen in temperature enough to become fully activated. This will be explained in detail with reference to FIG. 15 showing the maximum oxygen storage amount relative to the catalyst temperature. As shown in the figure, according to the conventional proposed methods, when the catalyst temperature TCAT is lower than a predetermined value (e.g. 400° C.), it is presumed that the catalytic converter is not activated, and then the feedback control based on the output from the downstream oxygen sensor is inhibited. However, as is understood from the figure, even when the catalyst temperature TCAT is below the predetermined value, if the catalytic converter is in a half-activated state, i.e. incompletely activated state (e.g. 200°–400° C.), it has some or less oxygen storage capacity. Nevertheless, according to the conventional proposed methods, even when the catalytic converter is in such a half-activated state, the feedback control based on the output from the downstream oxygen sensor is inhibited, thus failing to reduce emissions of noxious exhaust gas components on such an occasion.

Moreover, a feedback control constant, which is e.g. a proportional term, is employed to correct the air-fuel ratio correction coefficient KO2. If the feedback control constant is updated with an updating rate set with the catalytic converter being in an activated state, when the catalyst temperature is so low that the catalytic converter is not fully activated, the change rate of the feedback control constant becomes large due to a small maximum oxygen storage amount of the catalytic converter in a half-activated state. As a result, the change rate of the air-fuel ratio correction coefficient KO2 increases so that the air-fuel ratio of exhaust gases downstream of the catalytic converter fluctuates, rather leading to exhaust emission characteristics downstream of the catalytic converter.

SUMMARY OF THE INVENTION

It is an object of the invention to provide an air-fuel ratio control system for an internal combustion engine, which is capable of carrying out the feedback control based on the output from the downstream oxygen sensor even when the catalytic converter is in a half-activated state, to thereby improve exhaust emission characteristics of the engine.

It is a further object of the invention to provide an air-fuel ratio control system for an internal combustion engine, which dispenses with the use of a temperature sensor for sensing the catalyst temperature, thereby enabling a reduction in the manufacturing cost.

To attain the first-mentioned object, the present invention provides an air-fuel ratio control system for an internal combustion engine having an exhaust system, and a catalytic converter having a catalyst arranged in the exhaust system, comprising:

- an upstream oxygen sensor arranged in the exhaust system at a location upstream of the catalytic converter;
- a downstream oxygen sensor arranged in the exhaust system at a location downstream of the catalytic converter;
- feedback control constant-determining means for determining a feedback control constant, based on an output from the downstream oxygen sensor;
- feedback control means for determining an air-fuel ratio control amount, based on the feedback control constant determined by the feedback control constant-determining means and an output from the upstream oxygen sensor, and for feedback-controlling an air-fuel ratio of a mixture supplied to the engine by means of the determined air-fuel ratio control amount; and
- updating rate-setting means for setting an updating rate of the feedback control constant, based on temperature of the catalyst of the catalytic converter.

Preferably, the updating rate-setting means sets the updating rate of the feedback control constant to a lower value as the temperature of the catalyst is lower.

Further preferably, the feedback control constant is a control term for correcting the air-fuel ratio control amount.

Also preferably, the updating rate-setting means sets a correction term which is added to or subtracted from the control term, in response to the output from the downstream oxygen sensor, to thereby set the updating rate of the feedback control constant.

Advantageously, the control term is a proportional term applied upon inversion of the output from the upstream oxygen sensor.

To attain the second-mentioned object, the present invention provides an air-fuel ratio control system as claimed in claim 1, including catalyst temperature estimating means for estimating the temperature of the catalyst of the catalytic converter from operating conditions of the engine.

Preferably, the catalyst temperature-estimating means comprises steady condition temperature-calculating means for calculating a steady condition temperature of the catalyst of the catalytic converter in a steady condition of the engine, based on operating conditions of the engine at least including load on the engine, and follow-up speed-calculating means for calculating a follow-up speed of the temperature of the catalyst relative to the steady condition temperature, the catalyst temperature-estimating means estimating the temperature of the catalyst, based on the steady condition temperature and the follow-up speed.

Further preferably, the catalyst temperature-estimating means further comprises intake air temperature-detecting means for detecting intake air temperature of the engine, vehicle speed-detecting means for detecting speed of a vehicle on which the engine is installed, and correcting means for correcting at least one of the steady condition temperature and the follow-up speed, based on the intake air temperature and the vehicle speed, the catalyst temperature-estimating means estimating the temperature of the catalyst, based on the at least one of the steady condition temperature and the follow-up speed corrected by the correcting means.

The above and other objects, features, and advantages of the invention will be more apparent from the following detailed description taken in conjunction with the accompanying drawings.

DETAILED DESCRIPTION

The invention will now be described in detail with reference to the drawings showing an embodiment thereof.

Figure 1:
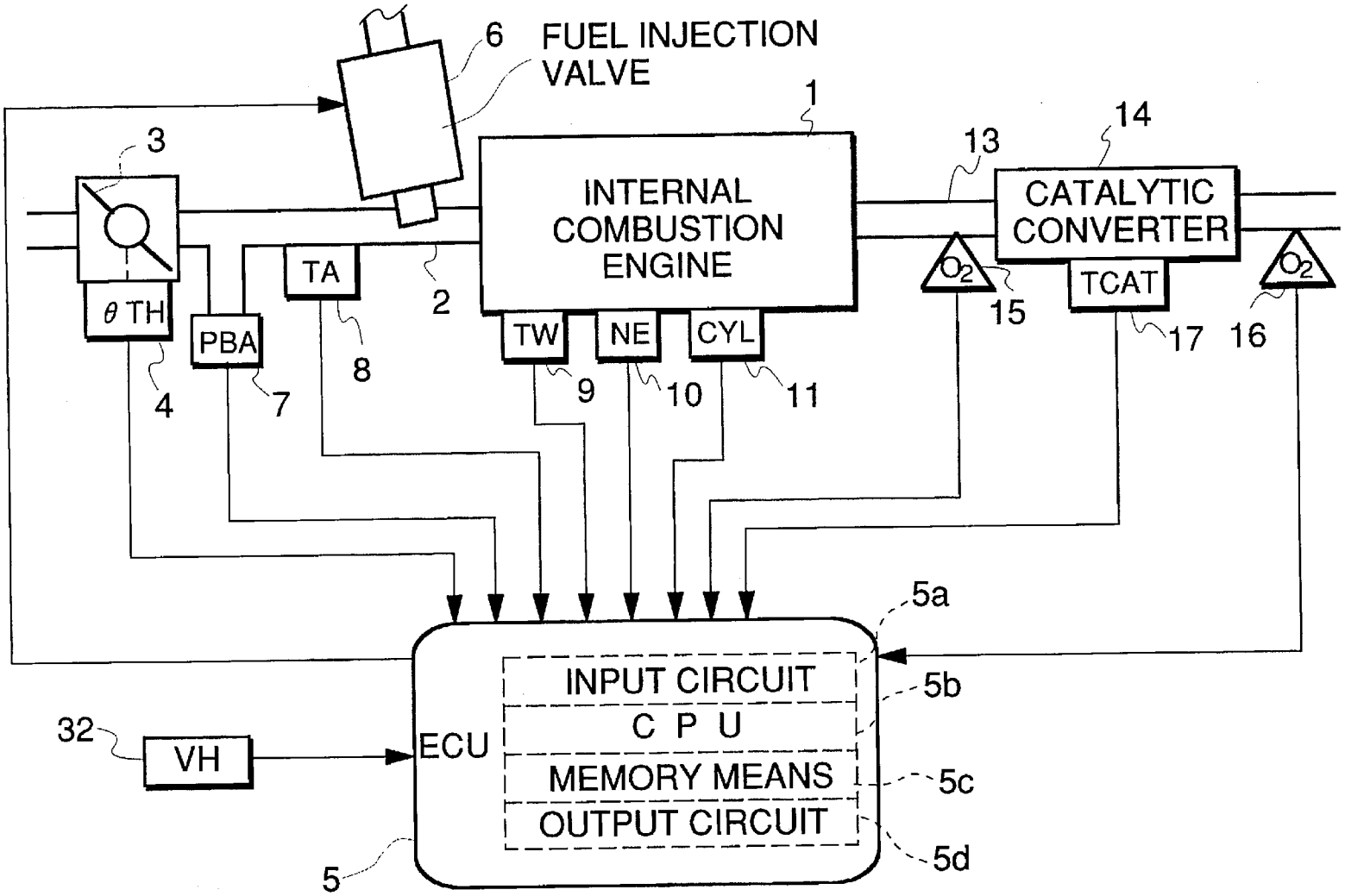
FIG. 1 is a schematic diagram showing the whole arrangement of an internal combustion engine and an air-fuel ratio control system therefor, according to an embodiment of the invention.

Referring first to FIG. 1, there is illustrated the whole arrangement of an internal combustion engine and an air-fuel ratio control system therefor, according to an embodiment of the invention.

In the figure, reference numeral 1 designates an internal combustion engine (hereinafter referred to as "the engine"). In an intake pipe 2 of the engine 1, there is arranged a throttle valve 3, to which is connected a throttle valve opening ($\theta$TH) sensor 4 for generating an electric signal indicative of the sensed throttle valve opening and supplying the same to an electronic control unit (hereinafter referred to as "the ECU") 5.

Fuel injection valves 6 are provided, respectively, for cylinders of the engine and each arranged in the intake pipe 2 at a location between the engine 1 and the throttle valve 3 and slightly upstream of an intake valve, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is provided in communication with the interior of the intake pipe 2 via a conduit 7 at a location immediately downstream of the throttle valve 3 for supplying an electric signal indicative of the sensed intake pipe absolute pressure to the ECU 5. An intake air temperature (TA) sensor 9 is inserted into the intake pipe 2 at a location downstream of the PBA sensor 8 for supplying an electric signal indicative of the sensed intake air temperature TA to the ECU 5.

An engine coolant temperature (TW) sensor 10, which may be formed of a thermistor or the like, is mounted in the cylinder block of the engine 1 for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The NE sensor 11 generates signal pulses (hereinafter referred to as "TDC signal pulses") at predetermined crank angles whenever the crankshaft rotates through 180 degrees, and the CYL sensor 12 generates a signal pulse (hereinafter referred to as "CYL signal pulses") at a predetermined crank angle of a particular cylinder of the engine 1. These signal pulses are supplied to the ECU 5.

A three-way catalyst (catalytic converter) 14 is arranged in an exhaust pipe 13 extending from the cylinder block of the engine 1 for purifying components of HC, CO, NOx, etc. present in the exhaust gases. Arranged in the exhaust pipe 13 at respective locations upstream and downstream of the three-way catalyst 14 are oxygen concentration sensors (hereinafter referred to as "the upstream O2 sensor" and "the downstream O2 sensor", respectively) 16 and 17 as air-fuel ratio sensors, for detecting the concentration of oxygen present in the exhaust gases at the respective locations, and supplying signals indicative of the sensed oxygen concentration to the ECU 5. A vehicle speed (VH) sensor 32 is also connected to the ECU 5.

The ECU 5 is comprised of an input circuit **5*a* having the function of shaping the waveforms of input signals from various sensors mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed by the CPU 5*b* and for storing results of calculations therefrom, etc., and an output circuit 5*d* which outputs driving signals to the fuel injection valves 6**.

The CPU **5*b* operates in response to the above-mentioned various engine parameter signals from the various sensors to determine operating conditions in which the engine 1 is operating, such as feedback control regions where the air-fuel ratio is controlled in response to the detected oxygen concentration in the exhaust gases, and open-loop control regions, and calculates, based upon the determined engine operating conditions, a fuel injection period Tout over which the fuel injection valve 6** is to be opened, in synchronism with generation of TDC signal pulses, by the use of the following equation (1):

$$Tout=Ti\times KO2\times KLS\times K1+K2 \quad (1)$$

where Ti represents a basic fuel injection amount, i.e. a basic value of the fuel injection period Tout, which is determined according to the engine rotational speed NE and the intake pipe absolute pressure PBA. A Ti map for determining the Ti value is stored in the memory means **5*c***.

KO2 represents an air-fuel ratio correction coefficient (hereinafter referred to simply as "the correction coefficient") as an air-fuel ratio control amount, which is calculated in response to the outputs from the O2 sensors 16 and 17 indicative of the oxygen concentration in exhaust gases sensed thereby. The correction coefficient KO2 is set to such a value that the air-fuel ratio of a mixture supplied to the engine becomes equal to a desired value when the engine 1 is operating in the air-fuel ratio feedback control region, based on the outputs from the O2 sensors 16 and 17, while it is set to predetermined values corresponding to the respective operating regions of the engine when the engine 1 is in the open-loop control regions.

KLS represents a mixture-leaning coefficient, which is set to a predetermined value smaller than 1.0 when the engine 1 is in a predetermined decelerating condition, while it is set to 1.0 when the engine is in a condition other than the predetermined decelerating condition.

K1 and K2 represent other correction coefficients and correction variables, respectively, which are set according to engine operating parameters to such values as optimize engine operating characteristics, such as fuel consumption and engine accelerability.

The CPU **5*b* supplies driving signals based on the results thus calculated via the output circuit 5*d* to the fuel injection valves 6**.

[Calculation of Air-Fuel Ratio Correction Coefficient]

Figure 2:
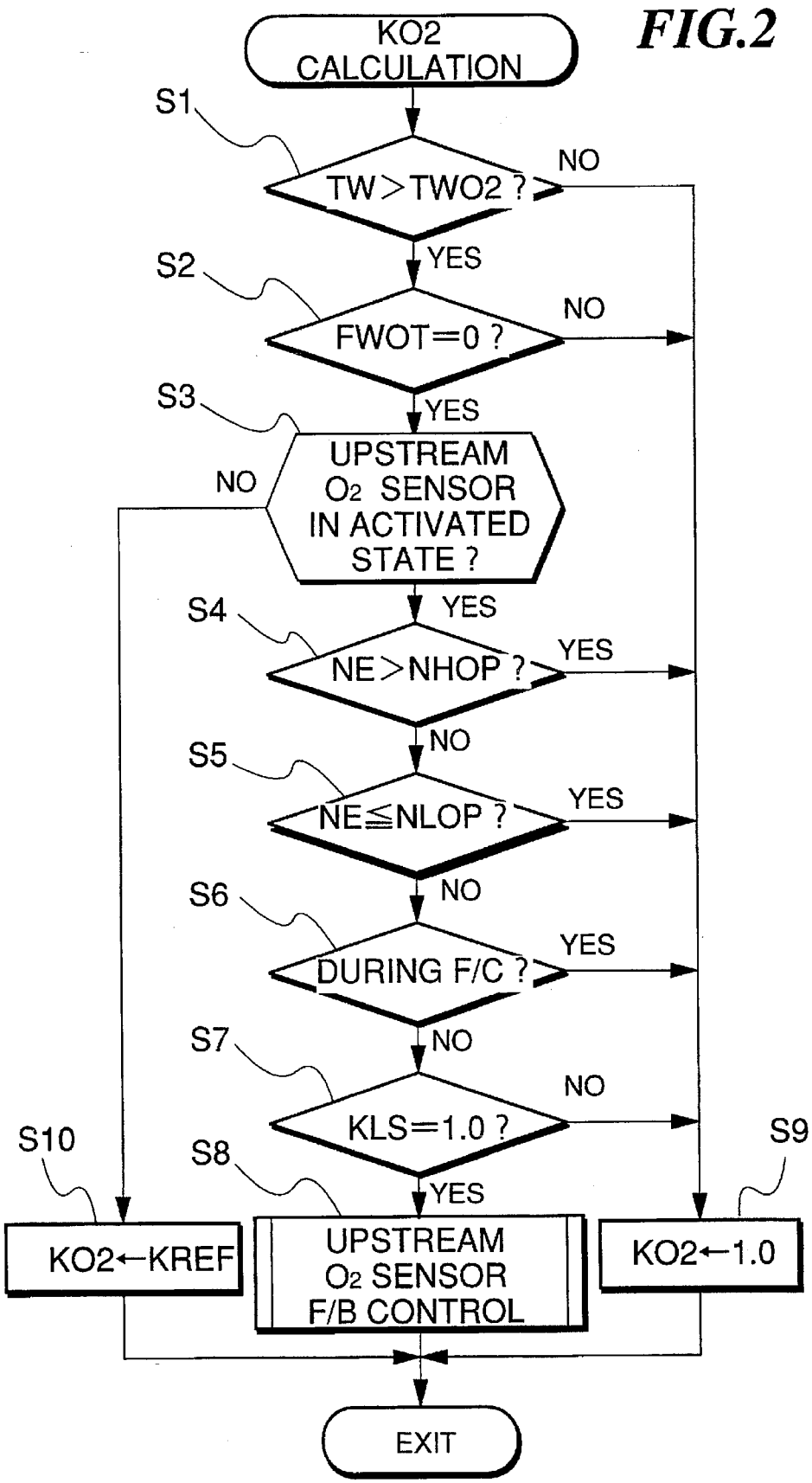
FIG. 2 is a flowchart showing a program for calculating an air-fuel ratio correction coefficient KO2 as an air-fuel ratio control amount.

FIG. 2 shows a program for calculating the value of the air-fuel ratio correction coefficient KO2. This program is executed at regular time intervals (e.g. 5 msec).

At steps S1 to S7, it is determined whether or not a first feedback control-effecting condition is satisfied, to carry out the air-fuel ratio feedback control based on the output from the upstream O2 sensor 16. More specifically, it is determined whether or not the engine coolant temperature TW is higher than a first predetermined value TWO2 (e.g. 25° C.) (step S1), whether or not a flag FWOT, which is set to 1 when the engine is in a predetermined high load operating condition (step S2), whether or not the upstream O2 sensor 16 is in an activated state (step S3), whether or not the engine rotational speed NE is higher than a predetermined high speed value NHOP (step S4), whether or not the engine rotational speed NE is equal to or lower than a predetermined low speed value NLOP (step S5), whether or not the engine is under fuel cut (step S6), and whether or not the mixture-leaning coefficient KLS has a value of 1.0 (step S7). It is determined that the first feedback control-effecting condition is fulfilled if the engine coolant temperature TW is higher than the predetermined value TWO2, FWOT=0, i.e. the engine is not in a predetermined high load-operating condition, the upstream O2 sensor 16 is activated, the engine rotational speed NE is in the relationship of $NLOP<NE\leqq NHOP$, and the engine is not under fuel cut, and KLS=1.0, i.e. the engine is not in a predetermined decelerating condition. Then, the program proceeds to a step S8, wherein the value of the air-fuel ratio correction coefficient KO2 is calculated based on the output from the upstream O2 sensor 16.

If TW>TWO2 and at the same time FWOT=0, i.e. the upstream O2 sensor 16 is not activated, the program proceeds to a step S10, wherein the correction coefficient KO2 is set to a learned value KREF of the correction coefficient KO2 calculated during the feedback control executed at the step S8x.

In a case other than the above cases, the program proceeds to a step S98, wherein the air-fuel correction coefficient KO2 is set to 1.0.

[Air-Fuel Ratio Feedback Control Based on Upstream O2 Sensor Output]

Figure 3:
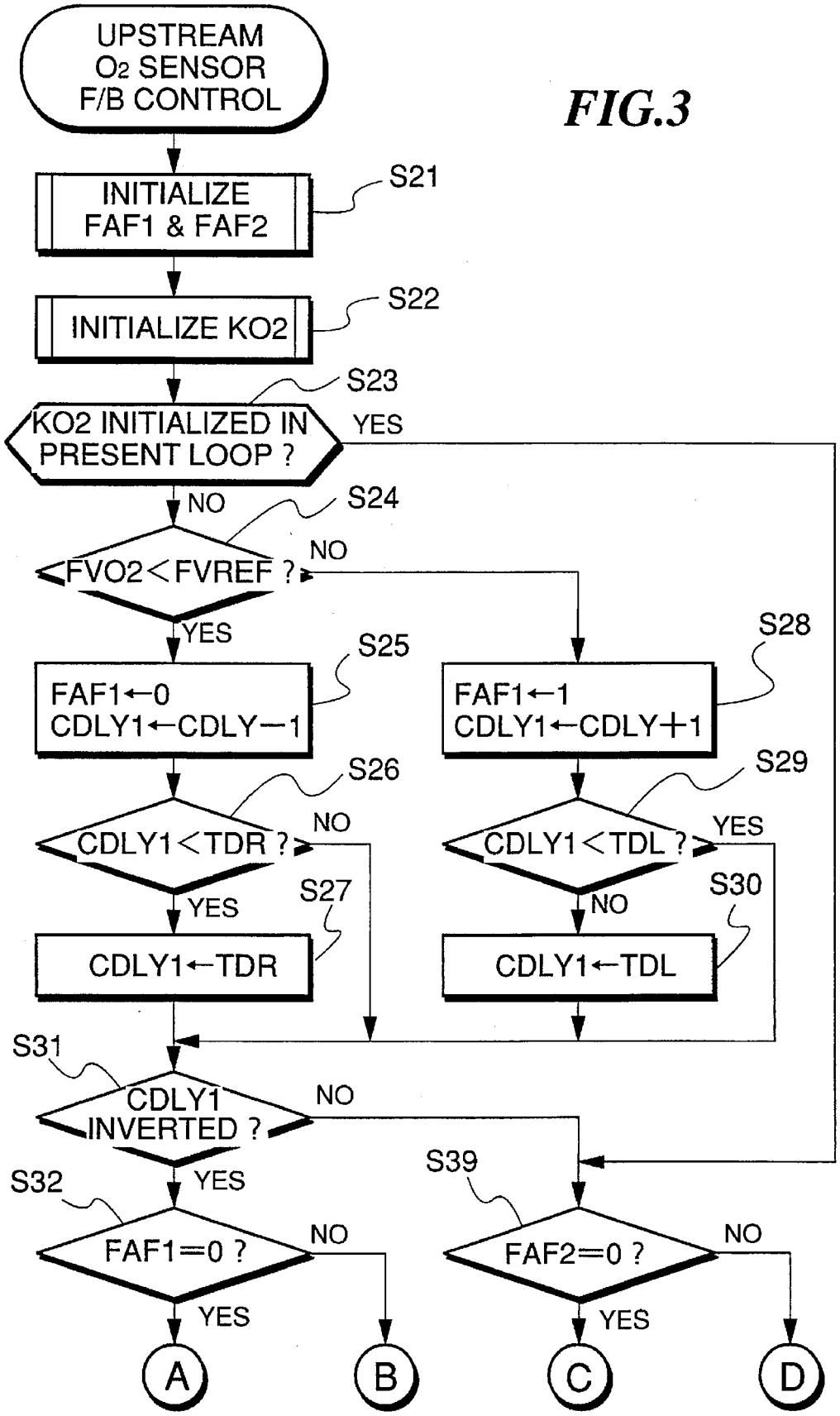
FIG. 3 is a flowchart showing details of a program executed at a step S8 in the flowchart of FIG. 2.
Figure 4:
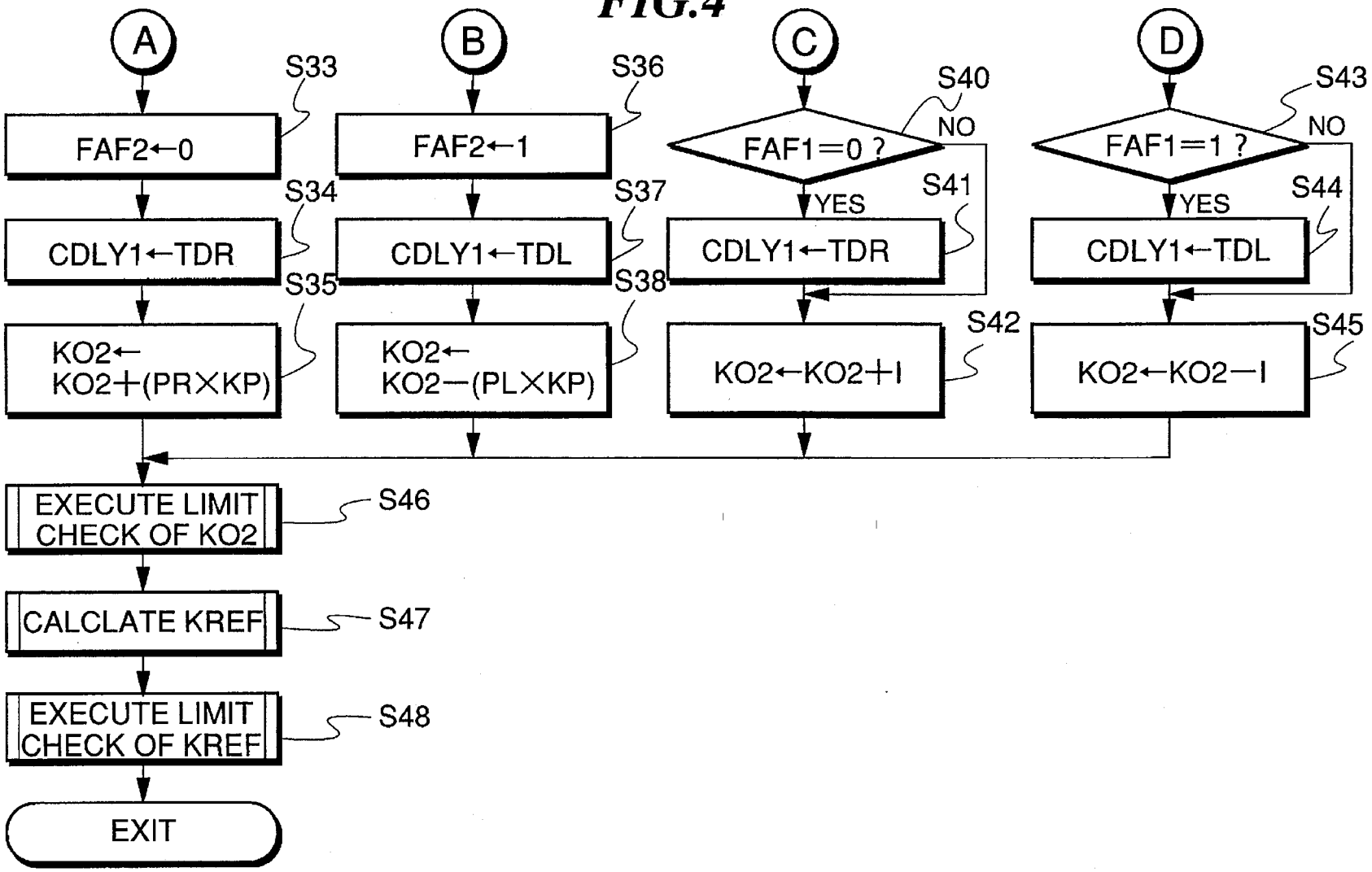
FIG. 4 is a continued part of the flowchart of FIG. 3.

FIGS. 3 and 4 show details of the program executed at the step S8, for calculating the value of the air-fuel ratio correction coefficient KO2 in response to output voltage FVO2 from the upstream O2 sensor 16.

First, at a step S21, first and second lean/rich flags FAF1 and FAF2 are initialized. The first lean/rich flag FAF1 indicates lean and rich states of the output FVO2 from the upstream O2 sensor 16, when set to "0" and "1", respectively, that is, when the output voltage FVO2 from the upstream O2 sensor drops below and rises above reference voltage FVREF (e.g. 0.45 volts), respectively, as shown at (a) and (b) in FIG. 6, and the second lean/rich flag FAF2 is set to the same value as the first lean/rich flag FAF1 after a predetermined delay time period has elapsed from the time of inversion of the first lean/rich flag FAF1 (0→1 or 1→0), as shown at (d) in FIG. 6.

Figure 5:
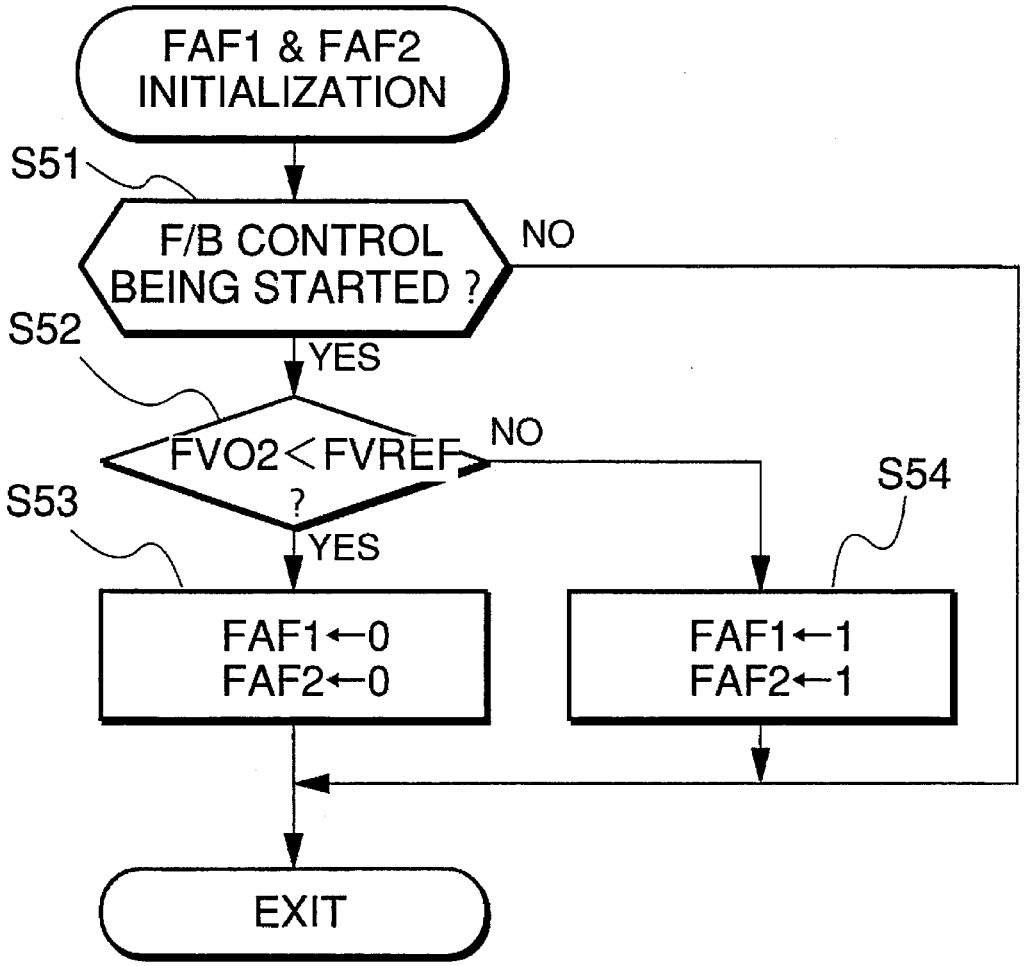
FIG. 5 is a flowchart showing a routine for initializing flags FAF1 and FAF2.

The initialization of these lean/rich flags FAF1, FAF2 is carried out by a program shown in FIG. 5. First, it is determined at a step S51 whether or not he feedback control has just been started, that is, the open loop control was carried out until the last loop and the feedback control is first started in the present loop. If the feedback control has not just been started, it is not necessary to initialize the lean/rich flags, and therefore the program is immediately terminated.

If the feedback control has been started in the present loop, it is determined at a step S52 whether or not the output voltage FVO2 from the upstream O2 sensor is lower than the reference voltage FVREF. If FVO2 FVREF, the first and second lean/rich flags FAF1, FAF2 are both set to 0 at a step S53, whereas if FVO2≧FVREF, the both lean/rich flags are set to 1 at a step S54.

Referring again to FIG. 3, initialization of the air-fuel ratio correction coefficient KO2 is carried out at a step S22. More specifically, immediately after shift from the open loop control to the feedback control, or when the throttle valve has been suddenly opened during the feedback control, the KO2 value is set to a learned value KREF as an initial value which is calculated at a step S47, hereinafter referred to.

At the next step S23, it is determined whether or not the air-fuel ratio correction coefficient KO2 has just been initialized in the present loop. If the KO2 value has been initialized, the program jumps to a step S39, whereas if it has not been initialized in the present loop, the program proceeds to a step S24.

At the start of the feedback control, the answer to the question of the step S23 is affirmative (YES), and then steps S39 to S45 are executed to make initialization of a counter CDLY1 for counting a P-term generation delay time and carry out integral control (I-term control) of the KO2 value, based on the first and second lean/rich flags FAF1, FAF2. As shown at (b), (c), and (d) in FIG. 6, the counter CDLY1 counts a delay time from the time the first lean/rich flag FAF1 is inverted to the time the second lean/rich flag FAF2 is inverted, i.e. a time period from the time of inversion of the O2 sensor output FVO2 to the time of execution of proportional control (P-term control).

At the step S39, it is determined whether or not the second lean/rich flag FAF2 is equal to 0. If FAF2 =0, the program proceeds to the step S40 in FIG. 4, wherein it is determined whether or not the first lean/rich flag FAF1 is equal to 0, whereas if FAF2=1, the program proceeds to the step S43 in FIG. 4, wherein it is determined whether or not the first lean/rich flag FAF1 is equal to 1. At the start of the feedback control, if FVO2<FVREF, FAF1=FAF2=0 (see FIG. 5). Therefore, the program proceeds through the steps S39 and S40 to the step S41, wherein the counter CDLY1 is set to a negative predetermined value TDR1 (e.g. a value corresponding to 120 msec) If FVO2≧FVREF, FAF1 =FAF2=1, and therefore the program proceeds through the steps S39 and S43 to the step S44, wherein the counter CDLY1 is set to a positive predetermined value TDL1 (e.g. a value corresponding to 40 msec). Unless the flags FAF1, FAF2 are both equal to 0 or 1, the initialization of the counter CDLY1 is not carried out. If FAF2=0, the KO2 value is increased by a predetermined value I at a step S42, whereas if FAF2=1, the KO2 value is decreased by the predetermined value I at the step S45, followed by the program proceeding to a step S46.

If the answer to the question of the step S23 in FIG. 3 is negative (NO), that is, if the KO2 value has not been initialized in the present loop, the program proceeds to the step S24, wherein it is determined whether or not the output voltage FVO2 from the upstream O2 sensor is lower than the reference voltage FVREF. If FVO2<FVREF, the program proceeds to a step S25, wherein the first lean/rich flag FAF1 is set to 0, and the P-term generation delay time counter CDLY1 is decremented by 1 (see regions T4 and T10 at (c) in FIG. 6). Then, it is determined at a step S26 whether or not the count of the counter CDLY1 is smaller than the negative predetermined value TDR1. If CDLY1<TDR1, the counter CDLY1 is set to the negative predetermined value TDR1 at a step S27, whereas if CDLY1≧TDR1, the program jumps to a step S31.

Figures 6A, 6B, 6C, 6D, 6E:
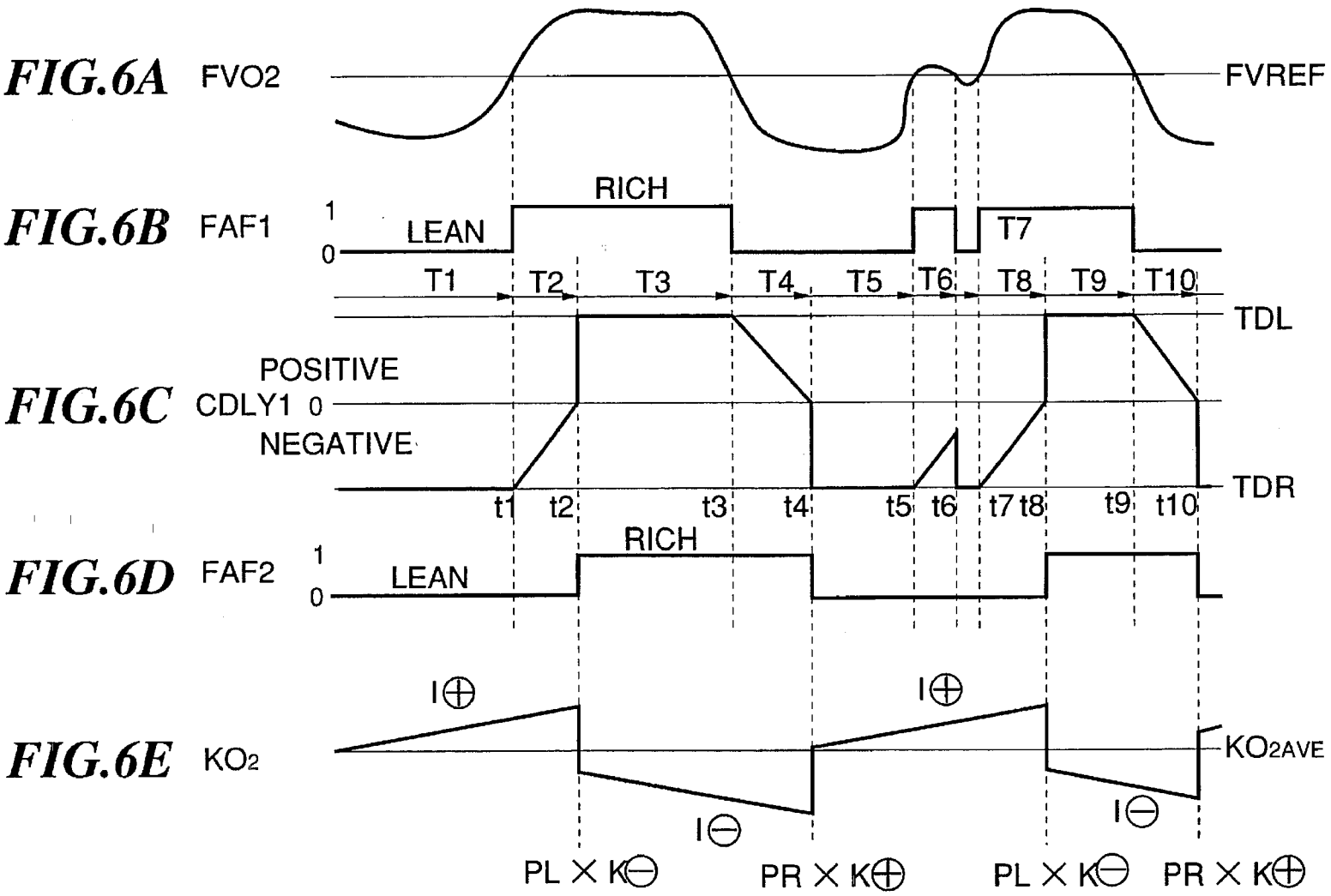
FIG. 6 is a timing chart showing changes in various variables with change in output voltage FVO2 from an upstream O2 sensor.

If the answer to the question of the step S24 is negative (NO), i.e. if FVO2≧FVREF, the program proceeds to a step S28, wherein the first lean/rich flag FAF1 is set to 1, and the counter CDLY1 is incremented by 1 (see regions T2, T6 and T8 at (c) in FIG. 6). Then, it is determined at a step S29 whether or not the count of the counter CDLY1 is larger than the positive predetermined value TDL1. If CDLY1>TDL1, the counter CDLY1 is set to the positive predetermined value TDL1 at a step S30, whereas if CDLY1≦TDL1, the program jumps to the step S31.

The above steps S26, S27, S29 and S30 are provided to prevent the count of the counter CDLY1 from decreasing below the negative predetermined value TDR1 and increasing above the positive predetermined value TDL1.

At the step S31, it is determined whether or not the count of the counter CDLY1 has been inverted in sign. If the sign has not been inverted, the I-term control is executed at the steps S39 to S45, whereas if it has been inverted, the P-term control is executed at steps S32 to S38.

At the step S32, it is determined whether or not the first lean/rich flag FAF1 is equal to 0. If FAF1=0, the program proceeds to the step S33, wherein the second lean/rich flag FAF2 is set to 0, and the count of the counter CDLY1 is set to the negative predetermined value TDR1 at the step S34. Then, the air-fuel ratio correction coefficient KO2 is calculated by the following equation (2) at the step S35 (see time points t4 and t10 in FIG. 6):

$$KO2=KO2+PR+KP \quad (2)$$

where PR represents a proportional term (P term) for correcting the KO2 value in the enriching direction (feedback control constant), and KP is a coefficient for increasing and decreasing the P-term. The coefficient KP is read from a KP map according to the engine rotational speed NE and the intake pipe absolute pressure PBA.

If the answer to the question of the step S32 is negative (NO), i.e. if FAF1=1, the second lean/rich flag FAF2 is set to 1 at the step S36, and the count of the counter CDLY1 is set to the positive predetermined value TDL1 at the step S37. Then, the air-fuel ratio correction coefficient KO2 is calculated by the following equation (3) (see t2 and t8 in FIG. 6):

$$KO2=KO2-PL\times KP \quad (3)$$

where PL is a proportional term (P term) for correction the KO2 value in the leaning direction (feedback control constant). The proportional terms PL and PR are calculated by a program in FIG. 8, hereinafter described.

At the next step S46, the KO2 value is subjected to limit checking in a known manner. Then, the learned value KREF of the correction coefficient KO2 is calculated at a step S47, and the calculated KREF value is subjected to limit checking in a known manner at a step S48, followed by terminating the program.

According to the program of FIGS. 3 and 4 described above, as shown in FIG. 6, the P-term control is executed (time points t2, t4, t8, and t10 in FIG. 6) after the lapse of a predetermined time period (T2, T4, T8, and T10 in FIG. 6) from the time of inversion of the output voltage FVO2 from the upstream O2 sensor (t1, t3, t7 and t9 in the FIG. 6). While the second lean/rich flag FAF2 assumes 0, the I-term control is continuously executed in the KO2-increasing direction (T1, T2, and T5 to T8), whereas while the flag FAF2 assumes 1, the I-term control is continuously executed in the KO2-decreasing direction (T3, T4, T9 and T10). It is seen in FIG. 6 that the sensor output FVO2 varies with a short variation period during time points t5 and t7. Since the variation period is shorter than the delay time period for the P-term control corresponding to the negative predetermined value TDR1, the second lean/rich flag FAF2 is not inverted so that the P-term control is not carried out.

[Air-Fuel Ratio Feedback Control Based on Downstream O2 Sensor Output]

Figure 7:
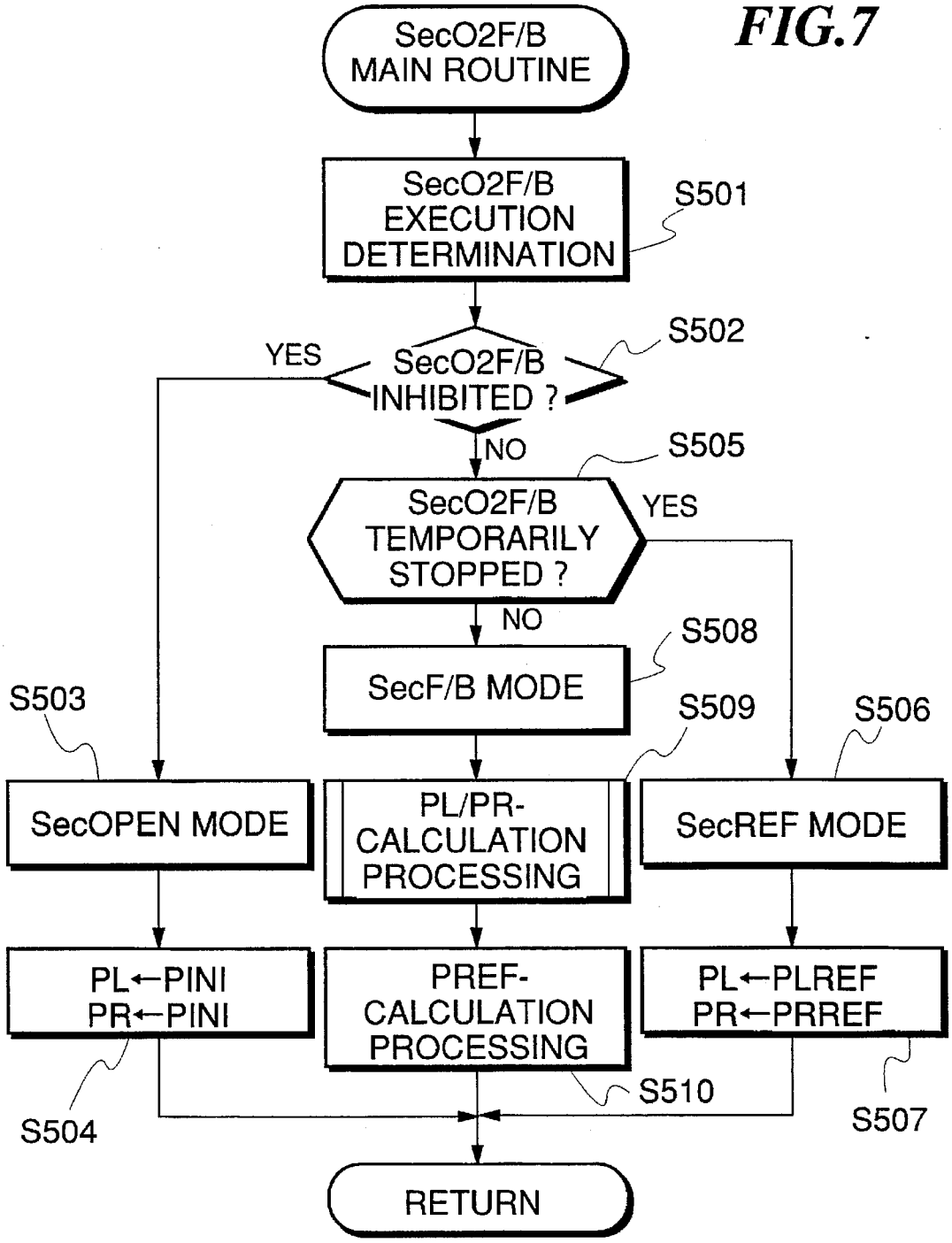
FIG. 7 is a flowchart showing a main routine for carrying out air-fuel ratio feedback control based on an output from a downstream O2 sensor.

FIG. 7 shows a main routine for carrying out air-fuel ratio feedback control based on the output from the downstream O2 sensor 17. This air-fuel ratio feedback control is for correcting a deviation in the control amount based on the output from the upstream O2 sensor 16, in response to the output RVO2 from the downstream O2 sensor 17.

First, at a step S501, a feedback control execution-determining processing is carried out to determine whether the air-fuel ratio feedback control (hereinafter referred to as "the secondary O2 sensor F/B control") based on the output RVO2 from the downstream O2 sensor 17 should be inhibited or temporarily stopped. The secondary O2 sensor F/B control is inhibited when disconnection/short-circuit of the downstream O2 sensor 17 is detected, when the air-fuel ratio feedback control based on the output from the upstream O2 sensor 16 is not being executed, when the engine is idling, etc. The secondary O2 sensor F/B control is temporarily stopped when the downstream O2 sensor 17 has not been activated (except that it is in a half-activated state), when the engine is in a transient state, when a predetermined time period has not elapsed after inhibition of the secondary O2 sensor F/B control, when a predetermined time period has not elapsed after temporary stoppage of the same, etc.

Then, at a step S502, it is determined whether or not the secondary O2 sensor F/B control is being inhibited. If the answer to the question is affirmative (YES), the program proceeds to a step S503, wherein the air-fuel ratio control is set to a downstream O2 sensor-open mode, and then the proportional terms PL and PR are both set to an initial value PINI of the proportional term at a step S504, followed by terminating the program.

If the answer to the question of the step S502 is negative (NO), it is determined at a step S505 whether or not the secondary O2 sensor F/B control is being temporarily stopped. If the answer to this question is affirmative (YES), the air-fuel ratio control is set to a REF-setting mode at a step S506, and then at a step S507 the proportional terms PL and PR are set to respective learned values PLREF and PRREF calculated by a PREF calculation processing, described hereinafter.

If the answer to the question of the step S505 is negative (NO), the air-fuel ratio control is set to a secondary O2 sensor F/B mode at a step S508, and at a step S509 the proportional terms PL and PR are calculated by a subroutine, described hereinafter. Further, the PREF-calculation processing is carried out at a step S510, followed by terminating the program.

Figure 8:
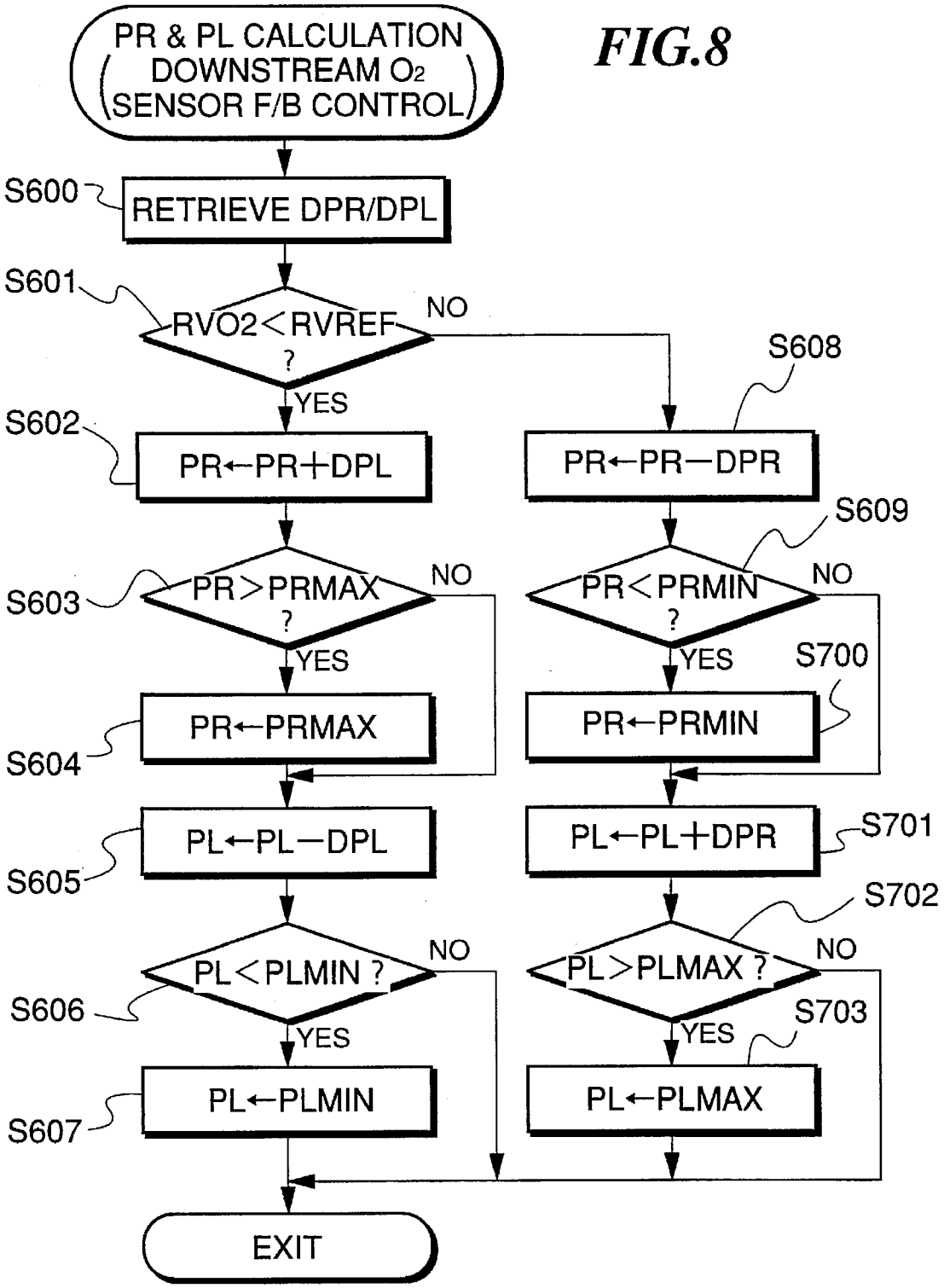
FIG. 8 is a flowchart showing a routine for calculating feedback control constants PR and PL.

FIG. 8 shows a program for calculating the proportional terms PL and PR executed at the step S509 in FIG. 7. In the present program, the PL and PR terms as the feedback control constants are calculated in response to the output RVO2 from the downstream O2 sensor 17. The PL and PR terms are applied in the feedback control based on the upstream O2 sensor 16, described hereinbefore with reference to FIGS. 3 and 4, to determine the skipping amount of the correction coefficient KO2.

The PL and PR values are basically calculated based on the output voltage RVO2 from the downstream O2 sensor 17 during execution of the secondary O2 sensor F/B control by the downstream O2 sensor 17. However, when the secondary O2 sensor F/B control cannot be executed, e.g. when the engine is idling, when the downstream O2 sensor 17 is in activated (except that the O2 sensor is half-activated), predetermined values or the learned values calculated during the feedback control are applied as the PL and PR values.

Figure 9:
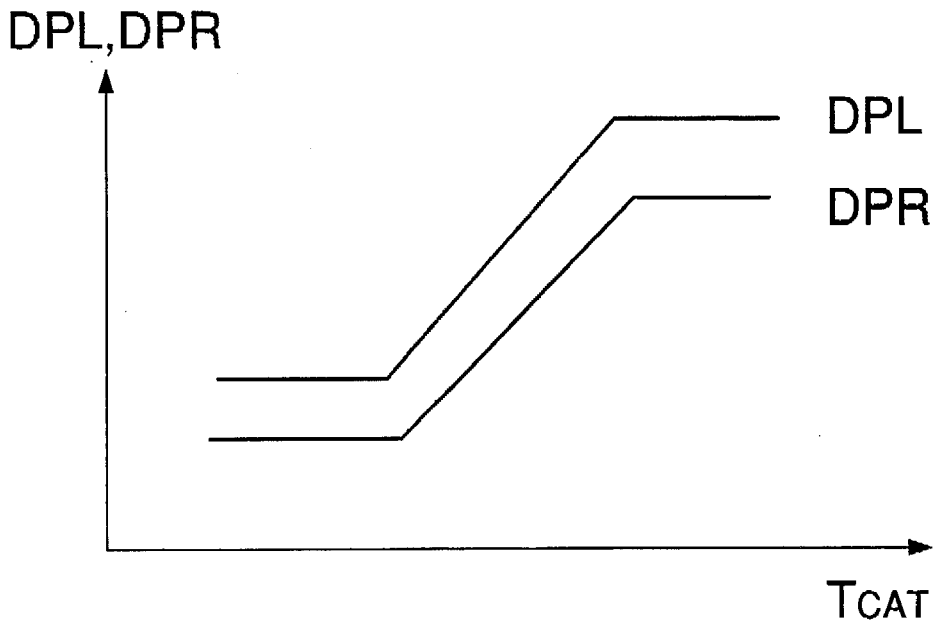
FIG. 9 is a graph showing DPL/DPR tables representative of correction terms DPL and DPR relative to the catalyst temperature TCAT.

First, at a step S600, correction terms DPL and DPR, which are subtracted from or added to the PL and PR terms when the output from the downstream O2 sensor 17 shows a rich air-fuel ratio or a lean air-fuel ratio, respectively, and which determine the updating rate of the proportional terms PL, PR as the feedback control constants, are read from DPL/DPR tables. The correction terms DPL, DPR are determined according to the catalyst temperature TCAT of the catalytic converter 14. FIG. 9 shows the DPL/DPR tables for determining the values of the correction terms DPL, DPR according to the catalyst temperature TCAT. According to the tables, when the catalyst temperature TCAT is low, e.g. when the catalytic converter 14 is in a half-activated state, the correction terms DPL, DPR are set to smaller values. The catalyst temperature TCAT is estimated by a catalyst temperature-estimating routine, hereinafter described.

Referring again to FIG. 8, at a step S601, it is determined whether or not the downstream O2 sensor output voltage RVO2 is lower than a reference value RVREF (e.g. 0.45 volts). if RVO2<RVREF, the program proceeds to a step S602, wherein the correction term DPL applied when the air-fuel ratio is determined to be lean is added to the PR value. If the PR value after the addition exceeds an upper limit value PRMAX at a step S603, the PR value is set to the upper limit value PRMAX at a step S604.

At the next step S605, the correction term DPL is subtracted from the PL value. If the PL value after the subtraction is smaller than a lower limit value PLMIN at a step S606, the PL value is set to the lower limit value PLMIN at a step S607.

On the other hand, if the answer to the question of the step S601 is negative (NO), i.e. if RVO2≧RVREF, the program proceeds to a step S608, wherein the correction term DPR applied when the air-fuel ratio is determined to be rich is subtracted from the PR value. If it is determined at a step S609 that the PR value after the subtraction is smaller than a lower limit value PRMIN, the PR value is set to the lower limit value PRMIN at a step S700.

Then, at a step S701, the correction term DPR is added to the PL value. If it is determined at a step S702 that the PL value after the addition is larger than an upper limit value PLMAX, the PL value is set to the upper limit value PLMAX at a step S703.

According to the program of FIG. 8, during a time period over which RVO2<RVREF holds, the PR value is increased within a range between the lower and upper limit values PRMIN and PRMAX, while the PL value is decreased within a range between the lower and upper limit values PLMIN and PLMAX. On the other hand, during a time period over which RVO2≧RVREF holds (T1 and T3), the PR value is decreased and the PL value is increased within the above-mentioned respective ranges.

As described above, according to the present embodiment, the correction terms DPL, DPR for correcting the proportional terms PL, PR as the feedback control constants are set to smaller values as the catalyst temperature TCAT of the catalytic converter 14 is lower. As a result, even when the catalytic converter 14 is in a half-activated state where the maximum oxygen storage amount of the catalytic converter 14 decreases, the change rate of the air-fuel ratio correction coefficient KO2 determining the air-fuel ratio control amount does not become higher, which makes it possible to start the air-fuel ratio feedback control based on the output from the downstream O2 sensor immediately when the catalytic converter 14 becomes half-activated, before it becomes fully activated.

[Estimation of Catalyst Temperature TCAT]

Figure 10:
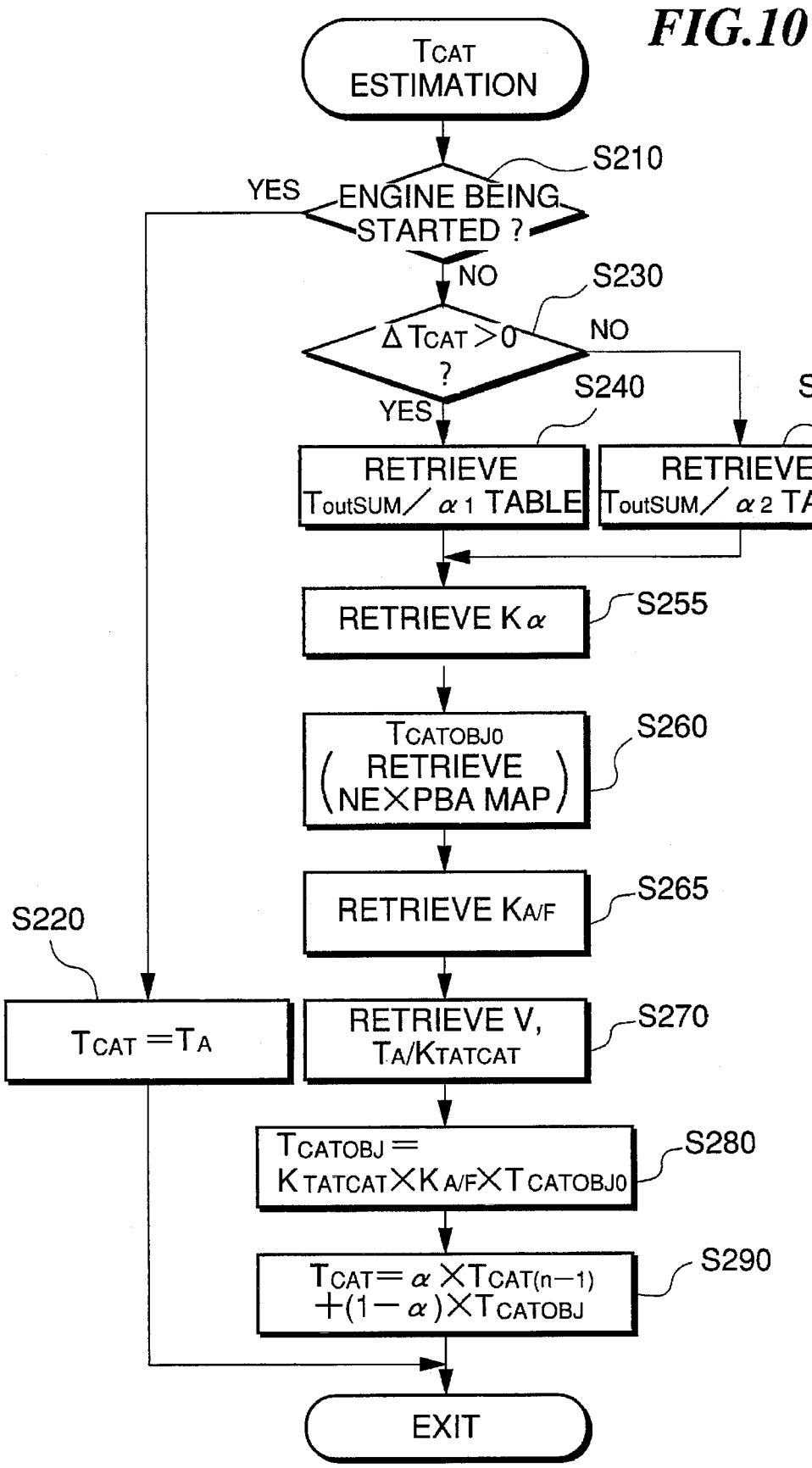
FIG. 10 is a flowchart showing a routine for estimating the catalyst temperature TCAT.
Figure 11:
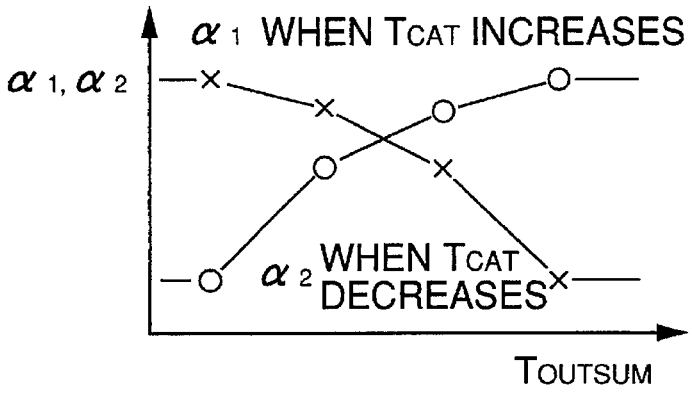
FIG. 11 is a graph showing values of coefficients $\alpha 1$ and $\alpha 2$ relative to a cumulative value TOUTSUM.

FIG. 10 shows a routine for estimating the catalyst temperature TCAT. At a step S210, it is determined whether or not the engine is in a starting mode. If the engine is in the starting mode, the catalyst temperature TCAT is set to the intake air temperature TA detected by the TA sensor 9, as an initial value of the catalyst temperature TCAT, at a step S220, followed by terminating the present routine. If the engine is not in the starting mode, the program proceeds to a step S215, wherein a difference ΔTCAT between the catalyst temperature TCAT and a desired estimated catalyst temperature TCATOBJ is calculated, and then it is determined at a step S230 whether or not the difference ΔTCAT between the catalyst temperature TCAT and the desired estimated catalyst temperature TCATOBJ is larger than "0" FIG. 11 shows the relationship between coefficients α1, α2 and a cumulative value TOUTSUM. After the start of the engine normally the catalyst temperature TCAT rises, and hence when the difference ΔTCAT value is positive, i.e. when the catalyst temperature. TCAT is lower than the desired estimated catalyst temperature TCATOBJ, a TOUTSUM/α1 table based on the relationship shown in FIG. 4 is retrieved to determine the coefficient α1 for raising the catalyst temperature TCAT based on the cumulative value TOUTSUM, at a step S240. On the other hand, when the ΔTCAT value is negative, i.e. when the catalyst temperature TCAT is higher than the desired estimated catalyst temperature TCATOBJ, a TOUTSUM/α2 table based on the relationship shown in FIG. 11 is retrieved to determine the coefficient α2 for lowering the catalyst temperature TCAT based on the cumulative value TOUTSUM at a step S250. The TOUTSUM value represents a cumulative value of the fuel injection period TOUT obtained over a predetermined unit time period. The larger the TOUTSUM value, the larger the combustion energy, resulting in an elevated catalyst temperature TCAT. Thus, the coefficients α1 and α2 designate time constants of delay exhibited in the catalyst temperature TCAT reaching the desired catalyst temperature TCATOBJ, which delay is determined from an average value (cumulative value) of the fuel injection amount over the predetermined unit time period, in other words, they represent follow-up speed of the catalyst temperature in reaching the desired value thereof, and the coefficient α1 is decreased as the cumulative value TOUTSUM is larger, whereas the coefficient α2 is increased as the cumulative value TOUTSUM is larger.

Then, at a step S255, a correction coefficient Kα for correcting the coefficients α1, α2 is determined based on the vehicle speed V and the intake air temperature TA.

Figure 13:
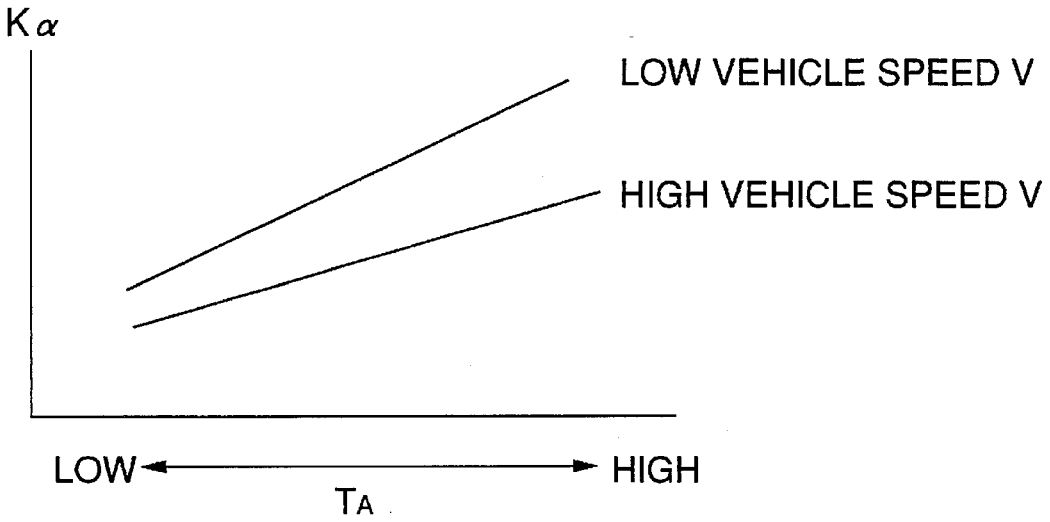
FIG. 13 is a graph showing a table for determining a correction coefficient $K\alpha$ according to the vehicle speed V and the intake air temperature TA.

FIG. 13 shows the relationship between the vehicle speed V and the intake temperature TA. The correction coefficient Kα. A Kα table is set based on this relationship, and hence according to the Kα table, the correction coefficient Kα is set to a larger value as the intake air temperature TA is higher, and at the same time to a smaller value as the vehicle speed is smaller. When the correction coefficient Kα has been retrieved from the Kα table at the step S255, the coefficient α is determined by the following equations (4*a*), (4*b*):

$$\alpha=\alpha 1\times K\alpha \quad (4a)$$

$$\alpha=\alpha 2\times K\alpha \quad (4b)$$

Figure 12:
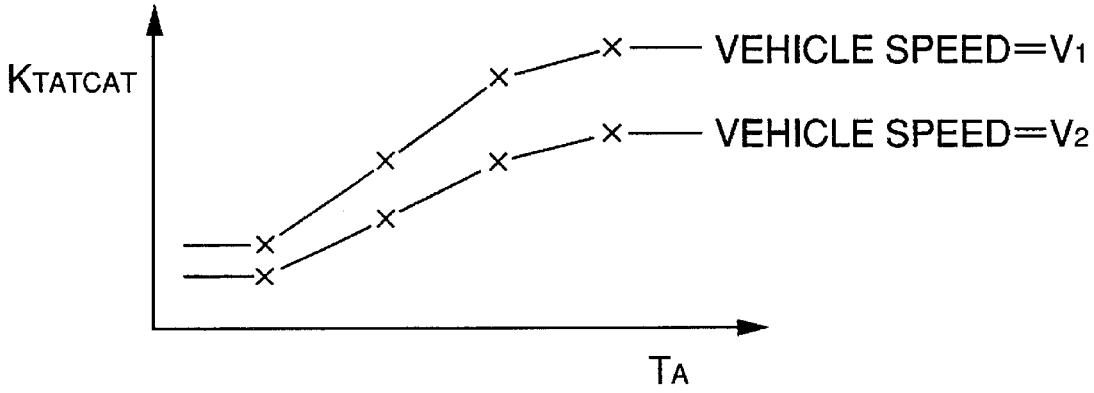
FIG. 12 is a graph showing a table for determining a correction coefficient KTATCAT according to intake air temperature TA and vehicle speed V.
Figure 14:
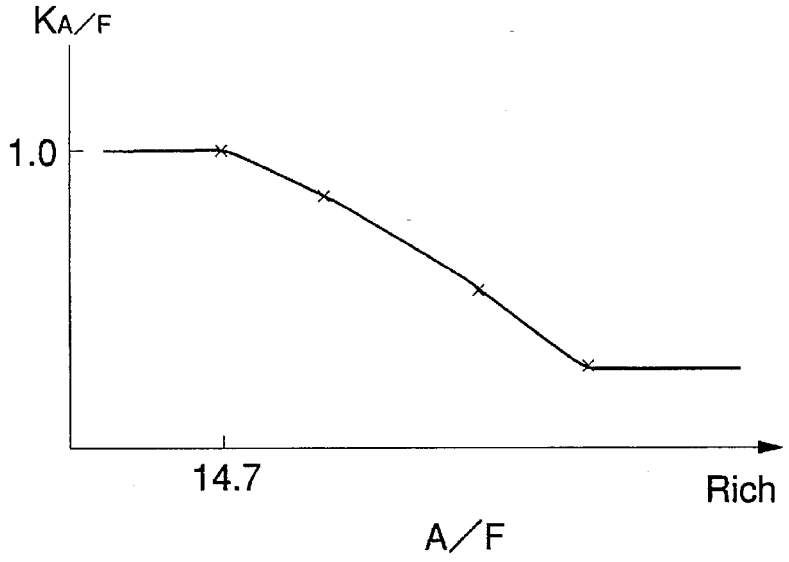
FIG. 14 is a graph showing a table for determining a correction coefficient KA/F according to the air-fuel ratio A/F.
Figure 15:
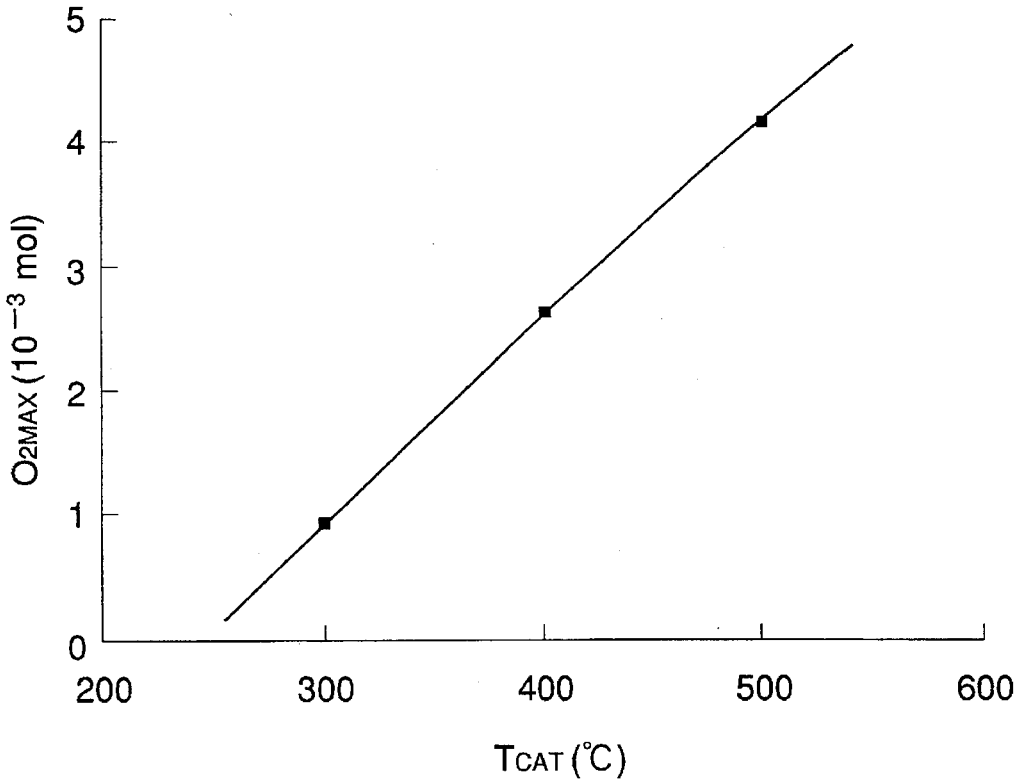
FIG. 15 is a graph showing the maximum oxygen storage amount of a catalytic converter relative to the catalyst temperature of the same.

Then, at a step S260, a basic value TCATOBJ0 of the desired estimated catalyst temperature TCATOBJ is determined by retrieving a map, not shown, according to the intake pipe absolute pressure PBA and the engine rotational speed NE. Then, at a step S265, an air-fuel ratio-dependent correction coefficient KA/F is determined by retrieving a KA/F table according to the air-fuel ratio A/F. The correction coefficient KA/F is for compensating for the cooling effect of fuel, in view of the fact that the richer the mixture, i.e. the smaller the air-fuel ratio in the exhaust system, the catalyst is more likely to be cooled. The coefficient KA/F is determined according to the air-fuel ratio of the mixture to which the air-fuel ratio in the exhaust system corresponds. FIG. 14 shows the relationship between the air-fuel ratio A/F and the correction coefficient KA/F, based on which the KA/F table is set. According to the KA/F table, the correction coefficient KA/F is set to a smaller value, as the air-fuel ratio A/F is richer. Then, at a step S270, a KTATCAT table is retrieved to determine a correction coefficient KTATCAT for the basic value TATOBJ0, according to the intake air temperature TA and the vehicle speed V. FIG. 12 shows the relationship between the intake temperature TA and the correction coefficient KTATCAT, based on which the KTATCAT table is set. According to the TA/KTATCAT table, in view of the fact that when the intake air temperature TA is low, the catalytic converter 14 is cooled by fresh air, the correction coefficient KTATCAT is set to a lower value as the intake air temperature TA is lower. In addition, as the vehicle speed V increases, the amount of heat released or dissipated from the catalytic converter 14 increases due to an increase in the volume of fresh air to which the vehicle, and hence the catalytic converter is exposed, and hence the cooling degree of the catalytic converter 14 by fresh air varies with the vehicle speed V. Therefore, the correction coefficient KTATCAT is also changed according to the vehicle speed V.

Then, the basic value TCATOBJ0 calculated is multiplied by the retrieved correction coefficients KA/F and KTATCAT, to thereby set the desired estimated catalyst temperature TCATOBJ which has thus been corrected for the intake air temperature TA, the vehicle speed V, and the air-fuel ratio A/F at a step S280 by the use of the following equation (5):

$$TCATOBJ=KTATCAT\times KA/F\times TCATOBJ0 \quad (5)$$

Then, based on the desired estimated catalyst temperature TCATOBJ thus set, a present value of the catalyst temperature TCAT(n) is calculated by the use of the following equation (6) at a step S290:

$$TCAT(n)=\alpha\times TCAT(n-1)+(1-\alpha)\times TCATOBJ \quad (6)$$

where TCAT(n−1) represents a value obtained in the immediately preceding loop. The calculation of the catalyst temperature TCAT(n) is followed by termination of the present routine.

Thus, by taking into account the cooling effect dependent on the concentration of fuel in the mixture, the ambient air temperature, and the vehicle speed, it is possible to accurately estimate the catalyst temperature TCAT. Further, since the catalyst temperature TCAT is estimated from the operating condition of the engine, the use of a catalyst temperature sensor is not required, leading to a reduction in the manufacturing cost, though alternatively a temperature sensor may be provided in the catalytic converter to directly detect the catalyst temperature TCAT.

According to the present embodiment, the follow-up speed ($\alpha 1$, $\alpha 2$) of the catalyst temperature is determined from the cumulative value TOUTSUM of the fuel injection amount representative of load on the engine, this is not limitative, but the follow-up speed may be directly determined from the intake pipe pressure also representative of load on the engine.

As described above, according to the present embodiment, even when the catalyst temperature TACT is so low that the catalytic converter 14 is in a half-activated state, the correction terms DPL, DPR for increasing and decreasing the feedback control constants PL, PR based on the output from the downstream O2 sensor 17, respectively, when the air-fuel ratio is determined to be rich and lean, in dependence on the catalyst temperature TCAT of the catalytic converter 14. As a result, the air-fuel ratio feedback control based on the downstream O2 sensor 17 can be carried out even before the catalytic converter 14 becomes fully activated, thereby improving exhaust emission characteristics of the engine.

In the present invention, the feedback control constants are not limited to the proportional terms PL, PR for skipping the correction coefficient KO2, but the control constants may be the I term, the predetermined values TDL1, TDR1 to be compared with the count of the counter CDLY for counting a delay time period after inversion of the output from the upstream O2 sensor 16, or the reference voltage FVREF to be compared with the output from the upstream O2 sensor.

In this connection, the integral term I, the predetermined values TDL1, TDR1, and the reference voltage FVREF are also corrected based on the output from the downstream O2 sensor 17, by routines, not shown.

What is claimed is:

1. An air-fuel ratio control system for an internal combustion engine having an exhaust system, and a catalytic converter having a catalyst arranged in said exhaust system, comprising:

an upstream oxygen sensor arranged in said exhaust system at a location upstream of said catalytic converter;

a downstream oxygen sensor arranged in said exhaust system at a location downstream of said catalytic converter;

feedback control constant-determining means for determining a feedback control constant, based on an output from said downstream oxygen sensor;

feedback control means for determining an air-fuel ratio control amount, based on said feedback control constant determined by said feedback control constant-determining means and an output from said upstream oxygen sensor, and for feedback-controlling an air-fuel ratio of a mixture supplied to said engine by means of the determined air-fuel ratio control amount; and updating rate-setting means for setting an updating rate of said feedback control constant, based on temperature of said catalyst of said catalytic converter.

2. An air-fuel ratio control system as claimed in claim 1, wherein said updating rate-setting means sets said updating rate of said feedback control-constant to a lower value as said temperature of said catalyst is lower.

3. An air-fuel ratio control system as claimed in claim 1, wherein said feedback control constant is a control term for correcting said air-fuel ratio control amount.

4. An air-fuel ratio control system as claimed in claim 3, wherein said updating rate-setting means sets a correction term which is added to or subtracted from said control term, in response to said output from said downstream oxygen sensor, to thereby set said updating rate of said feedback control constant.

5. An air-fuel ratio control system as claimed in claim 3, wherein said control term is a proportional term applied upon inversion of said output from said upstream oxygen sensor.

6. An air-fuel ratio control system as claimed in claim 5, wherein said updating rate-setting means sets a correction term which is added to or subtracted from said proportional term, in response to said output from said downstream oxygen sensor, to thereby set said updating rate of said feedback control constant.

7. An air-fuel ratio control system as claimed in claim 1, including catalyst temperature estimating means for estimating the temperature of said catalyst of said catalytic converter from operating conditions of said engine.

8. An air-fuel ratio control system as claimed in claim 7, wherein said catalyst temperature-estimating means comprises steady condition temperature-calculating means for calculating a steady condition temperature of said catalyst of said catalytic converter in a steady condition of said engine, based on operating conditions of said engine at least including load on said engine, and follow-up speed-calculating means for calculating a follow-up speed of said temperature of said catalyst relative to said steady condition temperature, said catalyst temperature-estimating means estimating the temperature of said catalyst, based on said steady condition temperature and said follow-up speed.

9. An air-fuel ratio control system as claimed in claim 8, wherein said catalyst temperature-estimating means further comprises intake air temperature-detecting means for detecting intake air temperature of said engine, vehicle speed-detecting means for detecting speed of a vehicle on which said engine is installed, and correcting means for correcting at least one of said steady condition temperature and said follow-up speed, based on said intake air temperature and said vehicle speed, said catalyst temperature-estimating means estimating the temperature of said catalyst, based on said at least one of said steady condition temperature and said follow-up speed corrected by said correcting means.

* * * * *